US005523535A

United States Patent [19]

Larsson et al.

[11] Patent Number: 5,523,535

[45] Date of Patent: Jun. 4, 1996

[54] ON-LOAD TAP CHANGER

[75] Inventors: Tommy Larsson; Sivert Norman, both of Ludvika, Sweden

[73] Assignee: Asea Brown Boveri AB, Västerås, Sweden

[21] Appl. No.: 362,503

[22] PCT Filed: Jul. 2, 1993

[86] PCT No.: PCT/SE93/00609

§ 371 Date: Jan. 3, 1995

§ 102(e) Date: Jan. 3, 1995

[87] PCT Pub. No.: WO94/01878

PCT Pub. Date: Jan. 20, 1994

[30] Foreign Application Priority Data

Jul. 9, 1992 [SE] Sweden ..... 9202122

[51] Int. Cl.[6] ..... H01H 19/12; H01H 19/54; H01F 29/02

[52] U.S. Cl. ..... 200/11 TC; 200/18

[58] Field of Search ..... 200/11 R, 11 B, 200/11 C, 11 J, 11 TC, 11 TW, 17 R, 18, 237–261; 323/340, 341, 343, 345

[56] References Cited

U.S. PATENT DOCUMENTS

| | | | |
|---|---|---|---|
| 2,717,296 | 9/1955 | Foley et al. | 200/11 B |
| 3,176,089 | 3/1965 | Bleibtreu et al. | 200/18 |
| 3,632,908 | 1/1972 | Bleibtreu et al. | 200/11 TC |
| 3,678,237 | 7/1972 | Rickert et al. | 200/166 E |
| 3,798,395 | 3/1974 | Norman et al. | 200/17 R |
| 3,902,030 | 8/1975 | Popa | 200/11 TC |
| 4,207,445 | 6/1980 | Hammar | 200/11 TC |
| 4,931,599 | 6/1990 | Bleibtreu | 200/11 B |
| 5,034,578 | 7/1991 | Lauterwald | 200/11 B |
| 5,191,179 | 3/1993 | Yatchum et al. | 200/11 TC |

FOREIGN PATENT DOCUMENTS

| | | | |
|---|---|---|---|
| 2945724 | 5/1980 | Germany | H01F 29/02 |

OTHER PUBLICATIONS

ABB Components Catalog—"ABB Components for the Worlds Transformer Industry, Technical Guide on Load Tup Changes Type UC", published by Globe, Luduika, Sweden, 1995–03–30, Rev. 2.

*Primary Examiner*—J. R. Scott

*Attorney, Agent, or Firm*—Watson Cole Stevens Davis

[57] ABSTRACT

A tap selector for an on-load tap changer includes two tap selector shafts (3, 4) made of metallic material and placed inside current collector rings (22). Movable contacts (6, 7) of the selector are supported by the shafts (3, 4) via contact holders (8) of insulating material. Between each current collector ring (22) and the shafts (3, 4) an insulating ring (21) is arranged. The fixed contacts (11) of the selector are supported by an electrically insulating, circular hollow cylinder (9) with a closed circumference, the contacts (11) being fixed to the cylinder wall by axial deformation. The cylinder (9) is provided with holes (10) for inspection and mounting. Each current collector ring (22) is connected by a screw joint to a current collector arm (24), which projects through a hole in the cylinder wall (9). Axial adjustment of the current collector arm (24) can be achieved by making the contact surfaces (25, 26) between the arm (24) and the ring (22) in the screw joint circularly curved in shape.

6 Claims, 4 Drawing Sheets

ON-LOAD TAP CHANGER

BACKGROUND OF THE INVENTION

1. Field of the Invention

The present invention relates to an on-load tap changer for regulating the voltage on a transformer while energized or on load which is of the type that includes a tap selector and a diverter switch. The central part of the tap selector includes support means for movable selector contacts for providing a connection between fixed contacts mounted in a circle on outer support means and current collector rings which are electrically connected to the diverter switch and which surround the central support means. The fixed contacts are arranged in through-holes in the outer support means such that both end portions of each contact extend on both sides of the support means, one end portion forming a contact part for cooperation with one of the movable contacts, the other end portion constituting a terminal intended to be electrically connected to one tap of a regulating transformer winding.

2. The Prior Art

From German Patent Document 2 945 724 an on-load tap changer that includes a tap selector and a diverter switch is previously known, in which the support means for the movable contacts of the tap selector consists of two parallel rods of insulating material which are placed inside the current collector rings of the tap selector. The fixed contacts of the tap selector are mounted on insulating bars which are arranged in parallel with and in a circle around the common axis of rotation of the two inner rods. The fixed contacts are fixed to the insulating bars by forming the end portion of the respective contact, after the contact has been placed in a through-hole in the bar, by transversal upsetting into a flat connection member which projects in the radial direction outside the hole.

From German Patent Document 2 105 604 an off-circuit tapping switch is previously known, in which the fixed contacts are fixed by upsetting to a cylindrical tube provided with mounting and inspection openings.

SUMMARY OF THE INVENTION

The object of the present invention is to provide a tap selector which has better electrical and mechanical properties than the above-mentioned design but which, in spite of this, is simpler and less expensive to manufacture.

In a selector of the above-mentioned kind with given radial dimensions, it is advantageous for the dielectric strength between the fixed contacts and the current collector rings if these rings can be made with as small a diameter as possible. To achieve this, the two selector shafts, which in a tap selector according to the invention are placed inside the current collector rings, must at the same time be made as rigid as possible, both with respect to bending and torsion. This is achieved according to the invention by constructing the selector shafts from a metallic material, for example steel or aluminium. A sufficient electrical insulation (corresponding to one regulating step, i.e., the voltage between two adjacent tappings of the regulating winding) between the current collector ring and the selector shafts is achieved with the aid of an intermediate insulating ring and with contact holders of insulating material.

By fixing the fixed contacts by upsetting in the axial direction, a more reliable mounting is achieved than with the above-mentioned attachment by transversal upsetting without any extra fixing components being needed.

By using as support member for the fixed contacts a circular insulating cylinder with a closed circumference (i.e. not axially divided), a high rigidity with respect to bending and torsion is achieved with a moderate thickness of the material in the cylinder wall. The current requirements that the contacts shall be capable of being inspected are fulfilled by providing relatively large holes in the cylinder wall. By these holes, the mounting of certain components included in the selector is also facilitated.

BRIEF DESCRIPTION OF THE DRAWINGS

The invention will be explained in greater detail by describing an embodiment with reference to the accompanying drawings.

DETAILED DESCRIPTION OF THE PREFERRED EMBODIMENT

Figure 1:
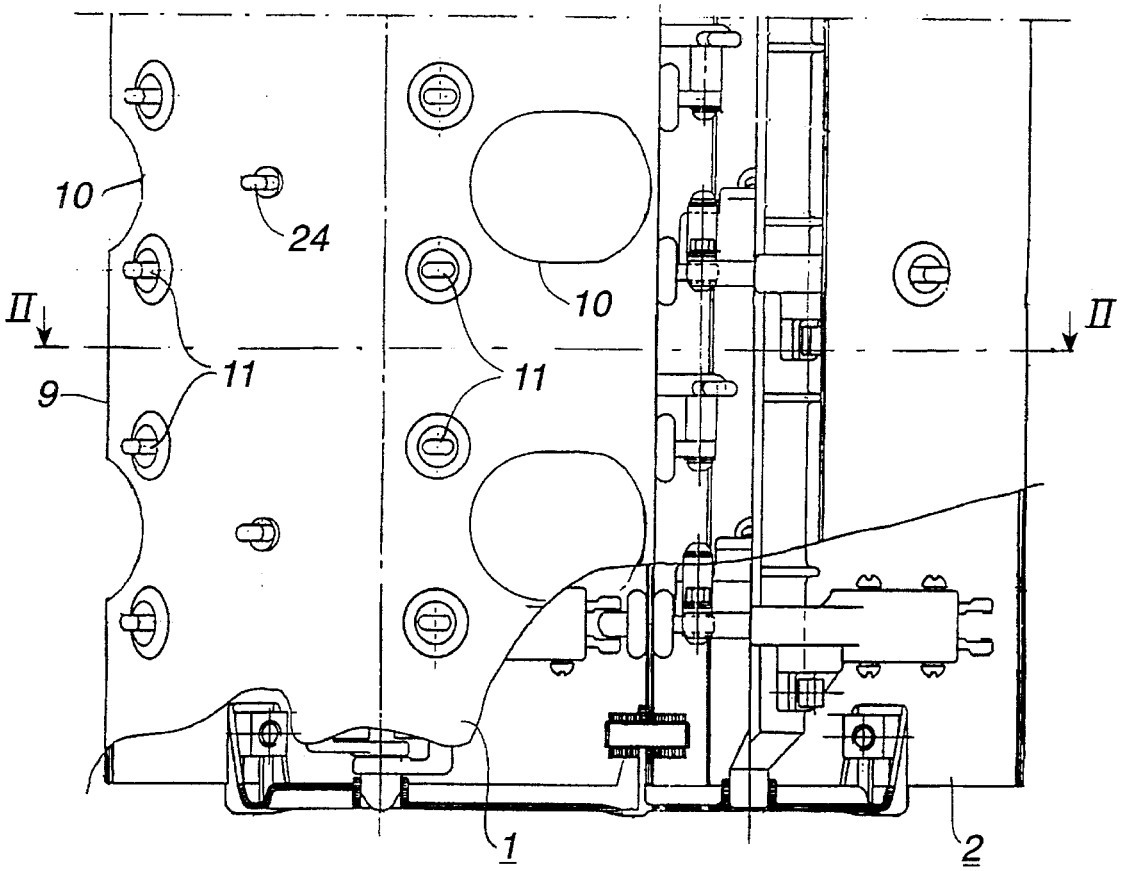
FIG. 1 shows in side view the lower part of a tap selector according to the invention.
Figure 2:
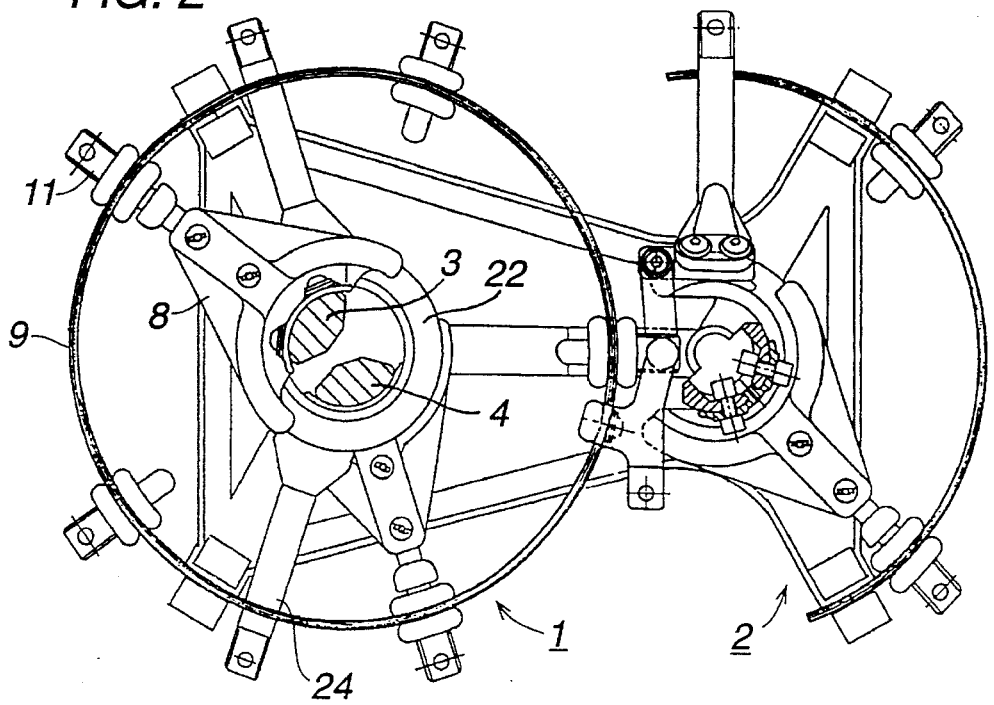
FIG. 2 shows a section along the line II—II in FIG. 1.

The tap selector, of which FIGS. 1 and 2 show part, comprises a so-called fine selector 1 and a changeover selector 2 for plus/minus or coarse/fine switching. The tap selector is intended to cooperate with a diverter switch (not shown) for switching during operation between different taps on a transformer winding. The fine selector 1 can be used also without the changeover selector 2. The present invention primarily concerns the fine selector, and therefore only this will be described in the following.

The central part in the fine selector consists of two parallel shafts 3 and 4 of metallic material, which are arranged equidistantly from a common axis of rotation 5 (FIG. 3) which is parallel to the shafts 3, 4. The two shafts 3, 4 are journalled for rotation around the axis of rotation 5 and are driven stepwise and alternately from a Geneva gear (not shown).

Figure 3:
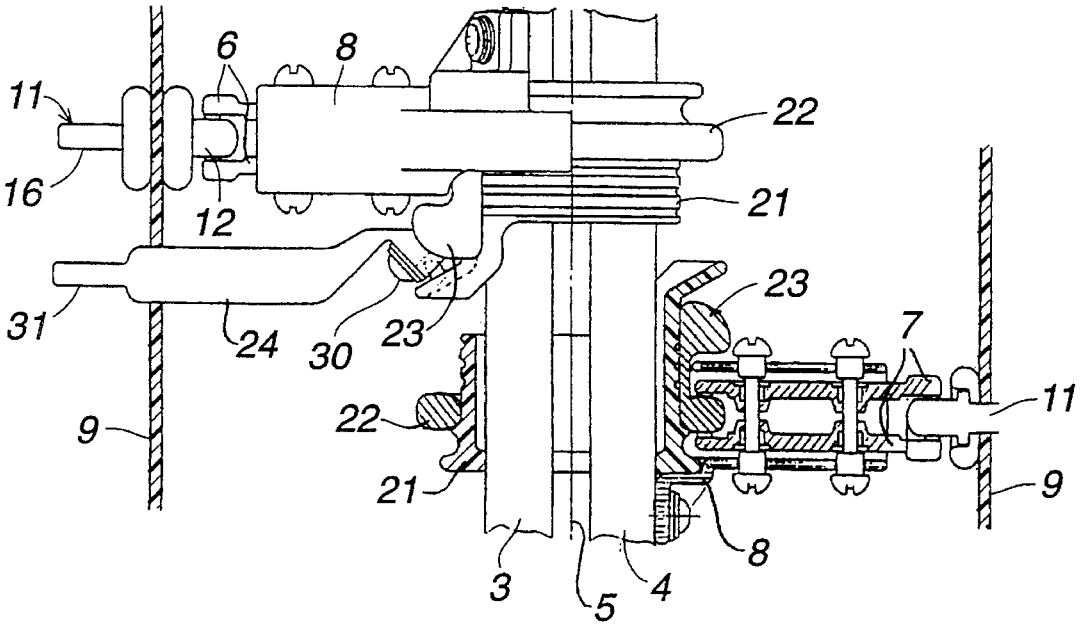
FIG. 3 shows the contact arrangement of the tap selector in side view and in cross section.

The shaft 3 supports up to three movable selector contacts. FIG. 3 shows one of these contacts, which is designated 6. In the same way, the shaft 4 supports up to three similar selector contacts. One of these contacts, which is designated 7, is shown in FIG. 3 in cross section.

The movable selector contacts 6, 7 are each supported by an electrically insulating contact holder 8, which is screwed to the shafts 3 and 4, respectively.

Each one of the movable selector contacts cooperates with a number of fixed contacts 11, which are supported by a circular-cylindrical insulating hollow cylinder 9 in such a way that the contacts 11 will be located on circular orbits which are concentric with the axis of rotation 5. The fixed contacts 11 are intended to be connected to different taps on the regulating winding of a transformer. In the cylinder 9 relatively large holes 10 are provided to facilitate inspection and mounting.

Figure 4:
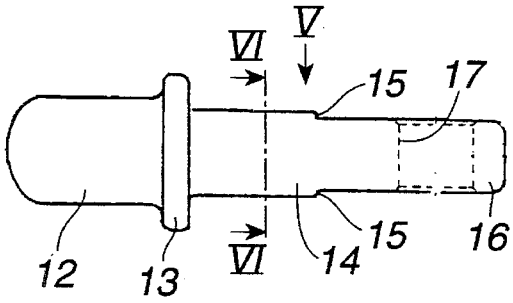
FIG. 4 shows in side view one of the fixed contacts of the selector prior to being mounted.
Figure 6:
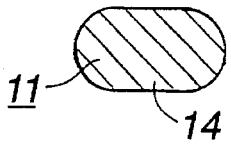
FIG. 6 shows a section along the line VI—VI in FIG. 4.
Figure 5:
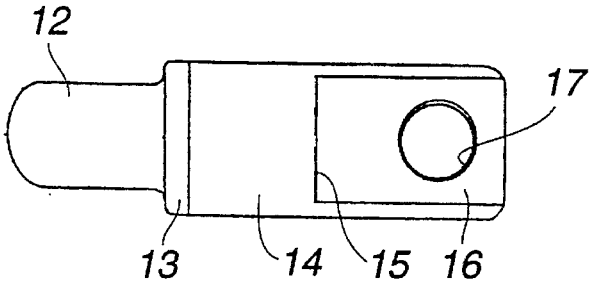
FIG. 5 shows the same contact in the direction of the arrow V in FIG. 4.

FIGS. 4–6 show one of the fixed contacts 11 of the selector before being mounted in the wall of the hollow cylinder. One end portion of the contact forms a contact part 12 for cooperation with one of the movable contacts 6, 7 of the selector. The contact part 12 changes into a flange portion 3, which in turn changes into a central portion 14 of oval cross section (FIG. 6). Via inward shoulders 15 on the opposite broad sides of the contact, the central portion changes into the other end portion of the contact, which end portion forms the connection member 16 for a connection conductor and is for this purpose provided with a hole 17 for a clamping bolt.

Figure 7:
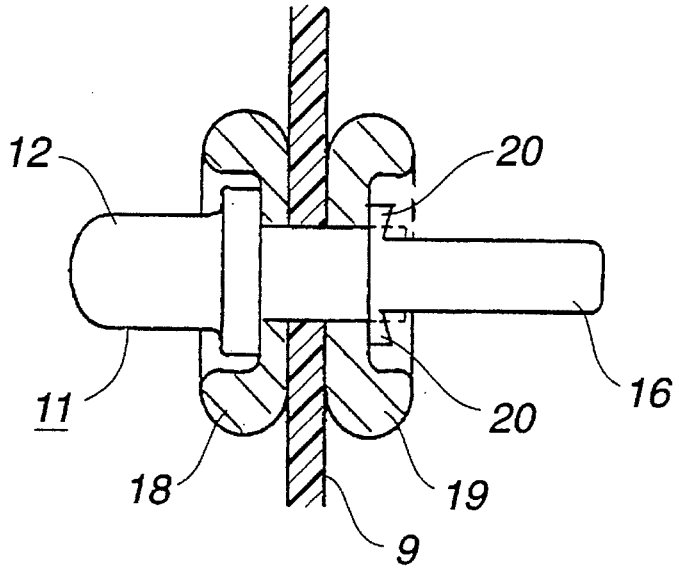
FIG. 7 shows one of the fixed contacts of the selector mounted in the contact-carrying cylinder wall of the selector.

FIG. 7 shows the fixed contact ill mounted in a hole, adapted to the cross section of the central portion 14, in the wall 9 of the selector cylinder together with an inner shield plate 18 and an outer shield plate 19. The attachment is achieved by axially upsetting that part of the central portion which is located nearest the shoulders 15, causing the central portion to become plastically deformed from the shape shown in dashed lines in FIG. 7 into two fins 20 projecting in opposite directions. The two shield plates 18, 19 are thereby clamped against the cylinder wall and fixed thereto together with the fixed contact 11. The mounting may, for example, be performed with a U-shaped press tool, one leg of which is inserted through one of the inspection holes 10 of the insulating cylinder to form a counter support by contact with the contact flange 13, the other leg of the tool supporting a screw device for applying compressive pressure to the shoulders 15.

Figure 8:
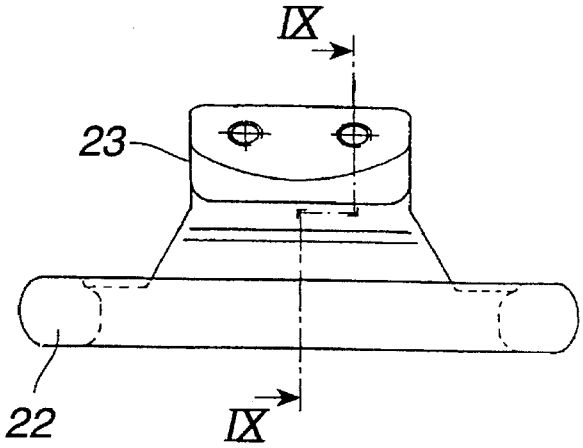
FIG. 8 shows in side view the current collector ring of the contact system.
Figure 9:
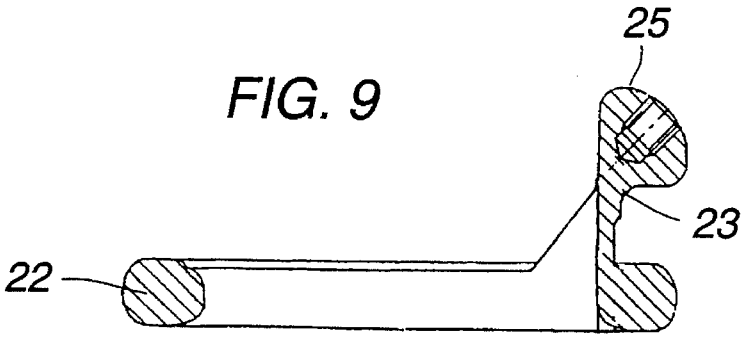
FIG. 9 shows a section along the line IX—IX in FIG. 8.
Figure 10:
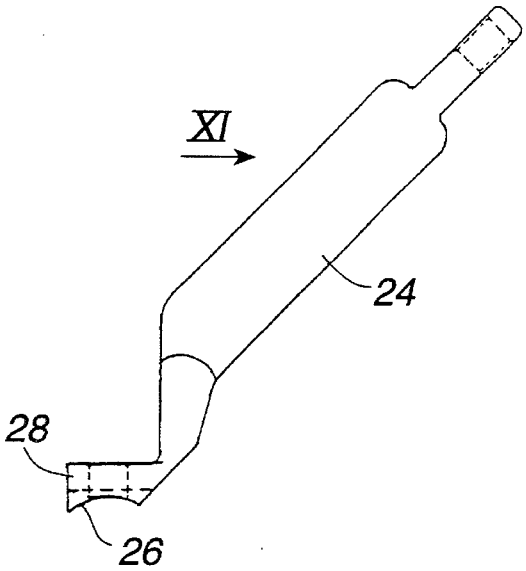
FIG. 10 shows in side view a current collector arm intended for connection to the current collector ring.
Figure 11:
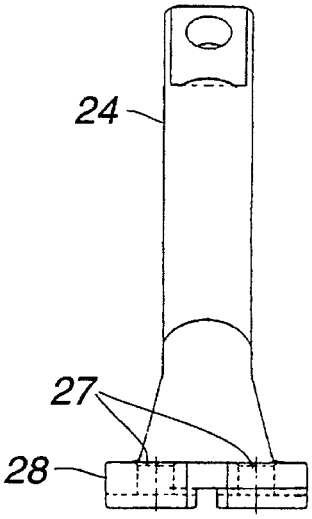
FIG. 11 shows the current collector arm in a view in the direction of the arrow XI in FIG. 10.
Figure 12:
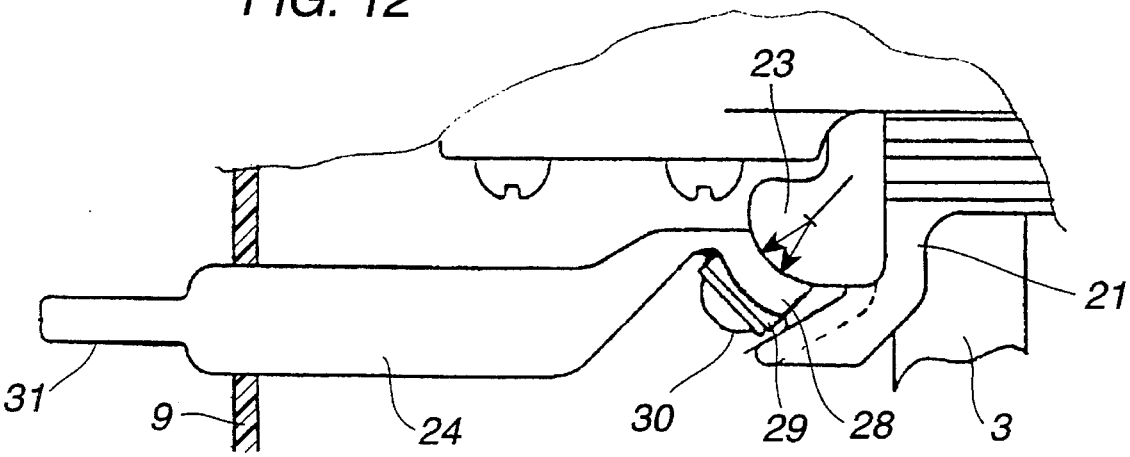
FIG. 12 shows in side view a screw joint between the current collector arm and the current collector ring.

Each movable selector contact 6 is adapted to connect one at a time of the fixed contacts 11 which are placed in the same circular orbit with a current collector ring 22, which is connected to the diverter switch of the on-load tap changer. The current collector ring 22 is arranged between an insulating ring 21, which surrounds the shafts 3, 4, and the contact holder 8 which is fixed to the respective shaft and exhibits an arc-shaped slot for the current collector ring and thus fixes this one in the axial direction. As is clear from FIGS. 8 and 9, the current collector ring 22 is provided with a connection projection 23, to which is affixed by means of screws 30 a current collector arm 24 which is shown separately in FIGS. 10 and 11. The current collector arm 24 projects through a hole in the insulating cylinder 9, and its outer end constitutes a terminal 31 for a connection conductor to the diverter switch. For reasons of manufacturing technique, it is difficult to achieve an exact fit in the axial direction between the selector shafts 3, 4 and the selector cylinder 9, and the current collector arm 24 must therefore be able to be adjusted axially. To achieve this, the connection projection 23 and the current collector arm 24 are provided with circularly excurvated contact surfaces 25 (FIG. 9) and circularly incurvated contact surfaces 26 (FIG. 10), respectively, in the screw joint. In this way and by providing a certain play between the fixing screws and the fixing holes 27 in the arm 24, a certain possibility of adjusting the position of the current collector arm in the vertical direction is obtained for fitting into the hole in the cylinder wall provided for the arm. This possibility of adjusting can be further improved by making both sides of the fixing projection 28 of the current collector arm coaxially cylindrical, as shown by FIG. 12, and placing a thrust washer 29 with a cylindrical surface, making contact with the fixing projection, below the respective bolt head. The attachment of the current collector arm 24 can be performed through the holes 10 in the cylinder 9 after the other parts of the selector have been mounted.

We claim:

1. An on-load tap changer for transformers, said tap-changer comprising a tap selector and a diverter switch, said tap selector (1) comprising:

central support means journalled for rotation in a stepwise manner around an imaginary axis (5), said central support means comprising two parallel shafts (3, 4) of metallic material which are rotatable stepwise and alternately around said axis, current collector rings (22) surrounding said central support means which are electrically connected to said diverter switch, outer support means (9), a plurality of circularly arranged fixed contacts (11) mounted on said outer support means, said fixed contacts being arranged in through-holes in said outer support means such that both end portions of each contact extend on both sides of said outer support means, one end portion forming a contact part (12), the other end portion constituting a terminal (16) intended to be electrically connected to one tap of a regulating transformer winding, movable selector contacts (6, 7) carried by said central support means and providing electrical connection between said fixed contacts and said current selector rings in a predetermined sequence, and electrically insulating contact holders (8) mounted on said two parallel shafts for supporting said movable selector contacts.

2. An on-load tap changer according to claim 1, including an insulating ring (21) which surrounds said two parallel shafts and wherein each of said current collector rings (22) is arranged between said insulating ring (21) and one of said contact holders (8).

3. An on-load tap changer according to claim 2, including a current collector arm (24) which extends through a hole in the outer support means (9) and wherein the current collector ring (22) is provided with a connection projection (23) connected to said current collector arm (24).

4. An on-load tap changer according to claim 3, wherein the connection projection (23) of the current collector ring (22) and the current collector arm (24) are formed with respectively abutting circularly excurvated and incurvated contact surfaces (25, 26).

5. An on-load tap changer according to claim 1, wherein each of said fixed contacts (11) is formed with a central portion (14) which is adapted to the cross section of the through-hole and has a greater length than the wall thickness of the outer support member (9), and wherein each of said fixed contacts (11) is fixed to the outer support member (9) by axially deforming at least part of said central portion (14) thereof to form a locking fin (20).

6. An on-load tap changer according to claim 1, wherein said outer support member (9) consists of an electrically insulating, circular hollow cylinder with a closed circumference and with a plurality of holes (10) provided in the cylinder wall for inspection and mounting of said fixed contacts.

* * * * *